US005403080A

United States Patent [19]

Thee

[11] Patent Number: 5,403,080

[45] Date of Patent: Apr. 4, 1995

[54] DEVICE FOR CONCEALING A LOUDSPEAKER

[76] Inventor: W. Christian Thee, 49 Stagecoach Rd., Weston, Conn. 06883

[21] Appl. No.: 95,928

[22] Filed: Jul. 22, 1993

[51] Int. Cl.[6] ..... A47B 97/00

[52] U.S. Cl. ..... 312/204; 181/199; 381/90; 381/188; 381/205

[58] Field of Search ..... 312/204, 7.1; 381/88, 381/90, 188, 205; 181/199

[56] References Cited

U.S. PATENT DOCUMENTS 5,170,436 12/1992 Powell ..... 381/90

FOREIGN PATENT DOCUMENTS 0782095 5/1935 France ..... 312/7.1
0452388 4/1950 Italy ..... 312/7.1
0642050 7/1962 Italy ..... 312/7.1
1531636 11/1978 United Kingdom ..... 381/88

*Primary Examiner*—Edward K. Look
*Assistant Examiner*—Christopher Verdier

[57] ABSTRACT

A device for concealing a loudspeaker has a box or panel with a wall having at least one opening therethrough and a screen or fabric covering the wall and presenting the appearance of a row of side-by side books.

7 Claims, 2 Drawing Sheets

DEVICE FOR CONCEALING A LOUDSPEAKER

BACKGROUND OF THE INVENTION

The invention relates to a device for concealing or camouflaging a loudspeaker or similar apparatus. Loudspeakers are usually rather unattractive when placed in a bookcase or on a piece of furniture, such as a desk.

It is therefore an object of the invention to provide means for simply and artfully disguising a loudspeaker.

SUMMARY OF THE INVENTION

In one of its aspects the device comprises a box with a wall provided with at least one opening therethrough for the passage of sound waves.

In another aspect the device comprises a structure of L-shaped cross section in which the long arm of the L forms a screen-like wall and the short arm is held in place by the loudspeaker.

BRIEF DESCRIPTION OF THE DRAWINGS

The invention is illustrated by way of example in the accompanying drawings, in which.

DETAILED DESCRIPTION OF PREFERRED EMBODIMENTS

Figure 3:
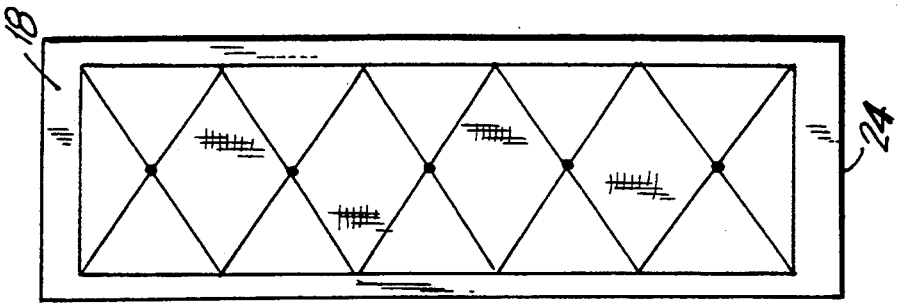
FIG. 3 is a side view thereof.
Figure 2:
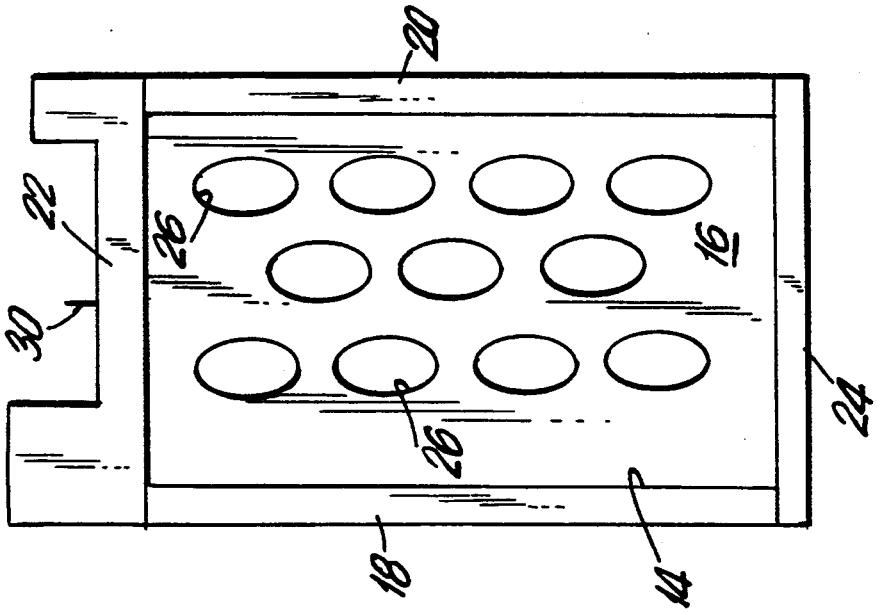
FIG. 2 is a rear view of the device.
Figure 1:
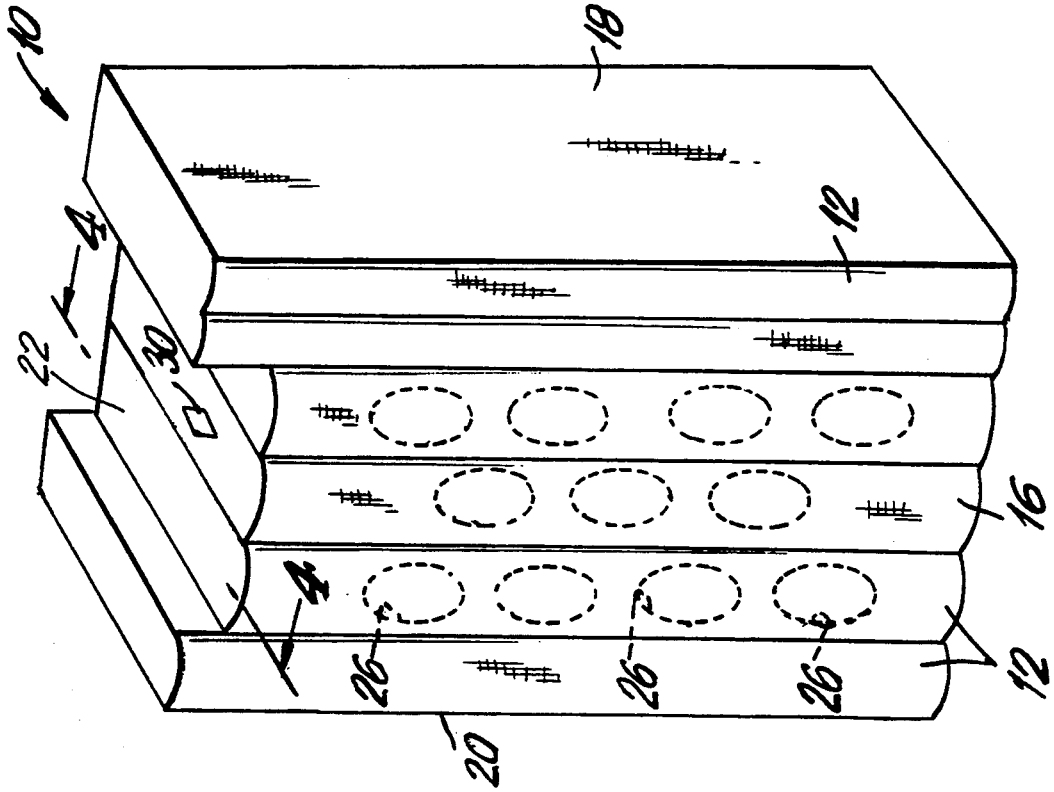
FIG. 1 is a perspective view of one embodiment of the loudspeaker concealing device according to the invention.
Figure 4:
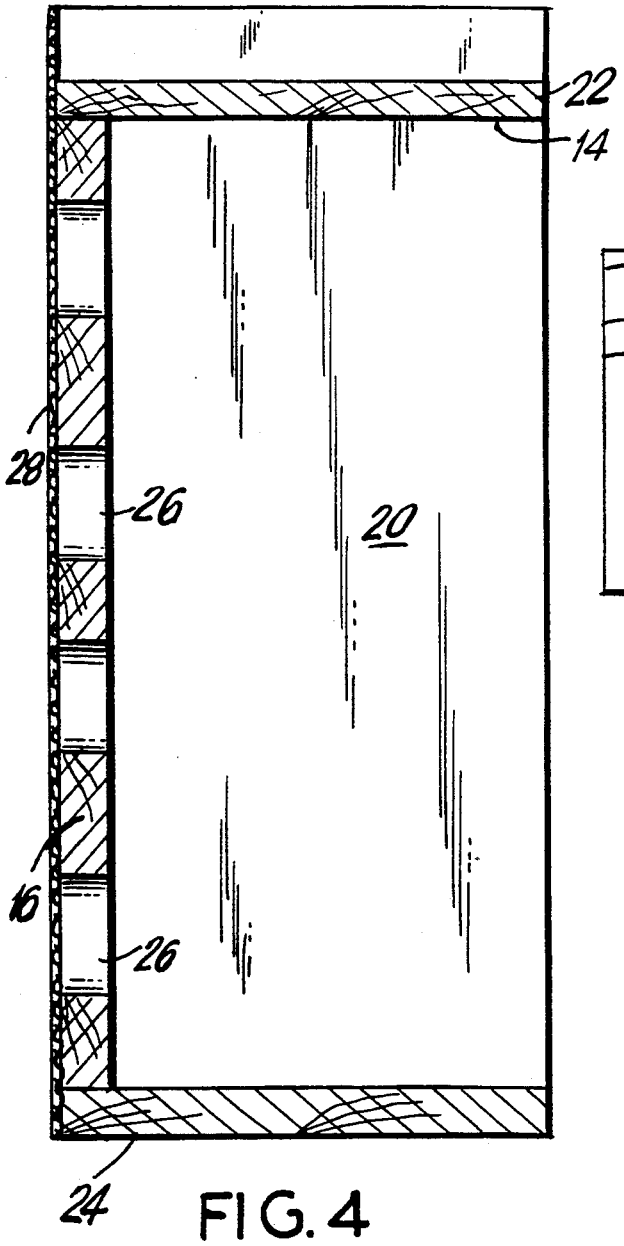
FIG. 4 is a partial section along lines 4—4 of FIG. 1.

Referring to FIGS. 1 to 4, one embodiment of my invention comprises a housing 10 presenting to the viewer the appearance of a row of books 12.The housing may be made of wood, plastic, or any other suitable material. It provides a hollow interior 14 for receiving the item to be concealed, in particular a loudspeaker ( not shown). The housing has a front wall 16, side walls 18, 20, a top wall 22 and optionally a bottom 24. Front wall 16 is provided with at least one opening 26, but preferably with a plurality of such openings, so as to permit the passage of soundwaves therethrough from the loudspeaker. Front wall 16 is dark and preferably black, accomplished for instance by painting. The front wall, as well as the side walls are covered by a fabric 28 of a type permitting the passage of sound therethrough. A suitable type is petit-point canvas. The part of the fabric covering the front wall may be decorated with markings representing the backs of rows of books. These backs may have different heights and widths, and different colors, so as to be a realistic representation of a row of books. Side walls 18 and 20 in turn may be decorated with designs that are customary for books or book covers. The top wall 22 may imitate gold-edged pages and even a bookmark 30. The housing may be closed by a back wall (not shown).

Figure 5:
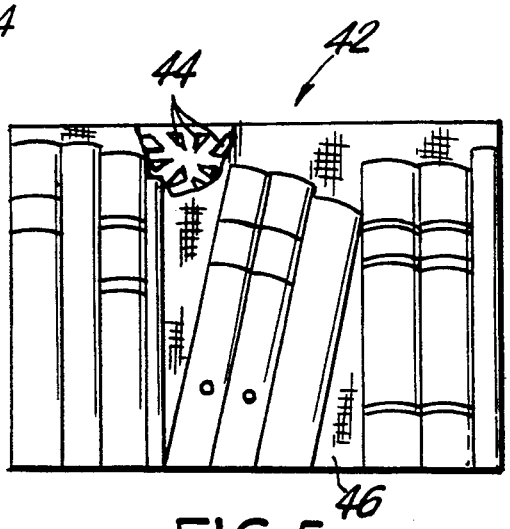
FIG. 5 is a front view of a second embodiment of my invention.
Figure 6:
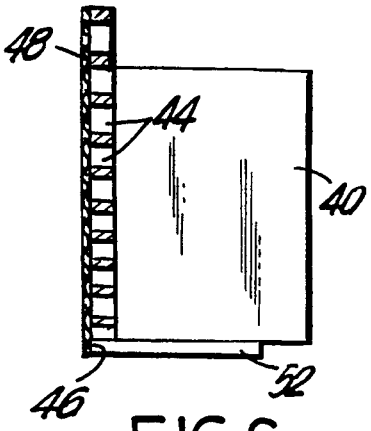
FIG. 6 is an end view thereof, partly in section.

In an alternative embodiment shown in FIGS. 5 and 6, a loudspeaker generally indicated by the numeral 40 is concealed by an L-shaped panel 42 of for instance wood or metal, having a plurality of perforations 44. The front face 46, or long arm of the L is painted black and is covered with fabric 48, again such as petit-point canvas. The canvas may be painted to resemble backs of books. Some may be arranged at an angle. The panel is held in place by the short arm 52 of the L being placed under the loudspeaker.

Figure 7:
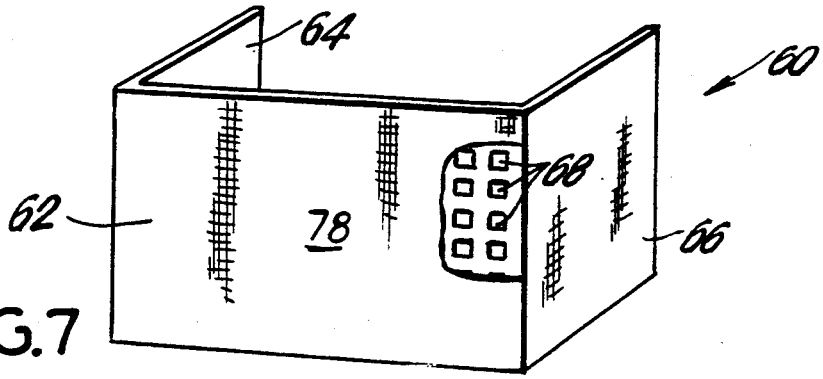
FIG. 7 is a perspective view of a third embodiment.

In still another embodiment shown in FIG. 7 the loudspeaker (not shown) may be hidden behind an essentially U-shaped panel 60 of the same type of material as panel 42 having a front wall 62 and side walls 64 and 66. The front wall is again provided with perforations 68 and covered by a fabric 70.

While three particular embodiments have been described above it is to be understood that I do not wish to be limited thereby but only by the scope of the appended claims.

I claim:

1. A concealing device comprising: a housing adapted to receive therein a loudspeaker, said housing having wall means provided with opening means therethrough for the passage of sound therethrough, said wall means having the appearance of a plurality of side-by-side books, and a screen covering said wall means on said face thereof remote from a loudspeaker when received in said housing, said screen being capable of permitting the passage of sound therethrough, said screen comprising a fabric.

2. A device according to claim 1, wherein said housing has two side walls essentially at right angles to said wall means, at least one of said side walls having the appearance of a cover of a book.

3. A device according to claim 2, wherein said housing has a top wall presenting the appearance of a plurality of books of uneven height.

4. A device according to claim 1, wherein said fabric is petit-point canvas.

5. A device according to claim 4, wherein said fabric is provided with markings representing the backs of books.

6. A concealing device comprising: an L-shaped panel having a wall with opening means therethrough, and a fabric covering said wall and capable of permitting the passage of sound therethrough and being provided with markings representing backs of books, said L-shaped panel having an arm connected to said wall for placement of a loudspeaker on said arm.

7. A concealing device according to claim 6, wherein said fabric is petit-point canvas.

* * * * *